US009523274B2

(12) United States Patent
Zweifel

(10) Patent No.: US 9,523,274 B2
(45) Date of Patent: Dec. 20, 2016

(54) TELEMETRY SYSTEM AND METHOD OF COMMUNICATING THROUGH A TUBULAR

(71) Applicant: Thomas J. Zweifel, Littleton, CO (US)

(72) Inventor: Thomas J. Zweifel, Littleton, CO (US)

(73) Assignee: BAKER HUGHES INCORPORATED, Houston, TX (US)

( * ) Notice: Subject to any disclaimer, the term of this patent is extended or adjusted under 35 U.S.C. 154(b) by 418 days.

(21) Appl. No.: 13/933,735

(22) Filed: Jul. 2, 2013

(65) Prior Publication Data

US 2015/0007982 A1 Jan. 8, 2015

(51) Int. Cl.
*E21B 47/12* (2012.01)
*E21B 47/18* (2012.01)

(52) U.S. Cl.
CPC ..... *E21B 47/182* (2013.01); *E21B 47/12* (2013.01)

(58) Field of Classification Search
CPC ..... E21B 44/00; E21B 47/01; E21B 47/122; E21B 47/00; E21B 47/10; E21B 47/12; E21B 47/0006; E21B 47/18; E21B 41/0092; E21B 49/003
See application file for complete search history.

(56) References Cited

U.S. PATENT DOCUMENTS 3,791,043 A 2/1974 Russell
6,298,734 B1 * 10/2001 Storer ..... G01F 1/3218 73/861.22
7,377,326 B2 5/2008 Shuster et al.
8,286,717 B2 10/2012 Giroux et al.
2002/0109080 A1 * 8/2002 Tubel ..... E21B 23/03 250/227.14
2009/0071645 A1 * 3/2009 Kenison ..... E21B 44/00 166/250.01
2013/0228373 A1 * 9/2013 Scholz ..... 175/24
2014/0202689 A1 * 7/2014 Walton et al. ..... 166/250.01

OTHER PUBLICATIONS

Chen, et al., "Numerical Simulation of MWD Pressure Pulse Transmission"; SPE 14324; Society of Petroleum Engineers; 60th Annual Technical Conference and Exhibition of the Society of Petroleum Engineers; Las Vegas, NV; Sep. 22-25, 1985; 8 pages.
Klotz, et al., "Highly Flexible Mud-Pulse Telemetry: A New System"; SPE 113258; Society of Petroleum Engineers; 2008 Indian Oil and Gas Technical Conference and Exhibition; Mumbai, India; Mar. 4-6, 2008; 6 pages.

* cited by examiner

*Primary Examiner* — Zakiya W Bates
(74) *Attorney, Agent, or Firm* — Cantor Colburn LLP

(57) ABSTRACT

A telemetry system including a tubular. A pump in operable communication with the tubular configured to pump a fluid through the tubular; a flow altering arrangement in operable communication with at least one of the pump and the tubular. A flow interacting detail disposed in the tubular; and a load sensor configured to detect forces imposed on the flow interacting detail due to flow through the flow interacting detail and output signals related to the forces detected. Also included is a method of communicating through a tubular.

21 Claims, 2 Drawing Sheets

TELEMETRY SYSTEM AND METHOD OF COMMUNICATING THROUGH A TUBULAR

BACKGROUND

A variety of systems and methods have been developed to allow communication through tubulars in industries such as hydrocarbon recovery and carbon dioxide sequestration, for example. Some of these systems employ mud pulse telemetry wherein pressure pulses are generated in fluid at one location along a tubular and are sensed in the fluid at another location along the tubular. These systems work fine for some applications; however those who practice in the art are always receptive to new systems and methods that overcome any limitations with the existing systems and methods.

BRIEF DESCRIPTION

A telemetry system including a tubular; a pump in operable communication with the tubular configured to pump a fluid through the tubular; a flow altering arrangement in operable communication with at least one of the pump and the tubular; a flow interacting detail disposed in the tubular; and a load sensor configured to detect forces imposed on the flow interacting detail due to flow through the flow interacting detail and output signals related to the forces detected.

A method of communicating through a tubular, including flowing fluid through a tubular having a flow interacting detail disposed therewithin; altering flow of the fluid through the tubular and the flow interacting detail; sensing force on the flow interacting detail related to the flow of the fluid; and tracking the sensed force over time.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
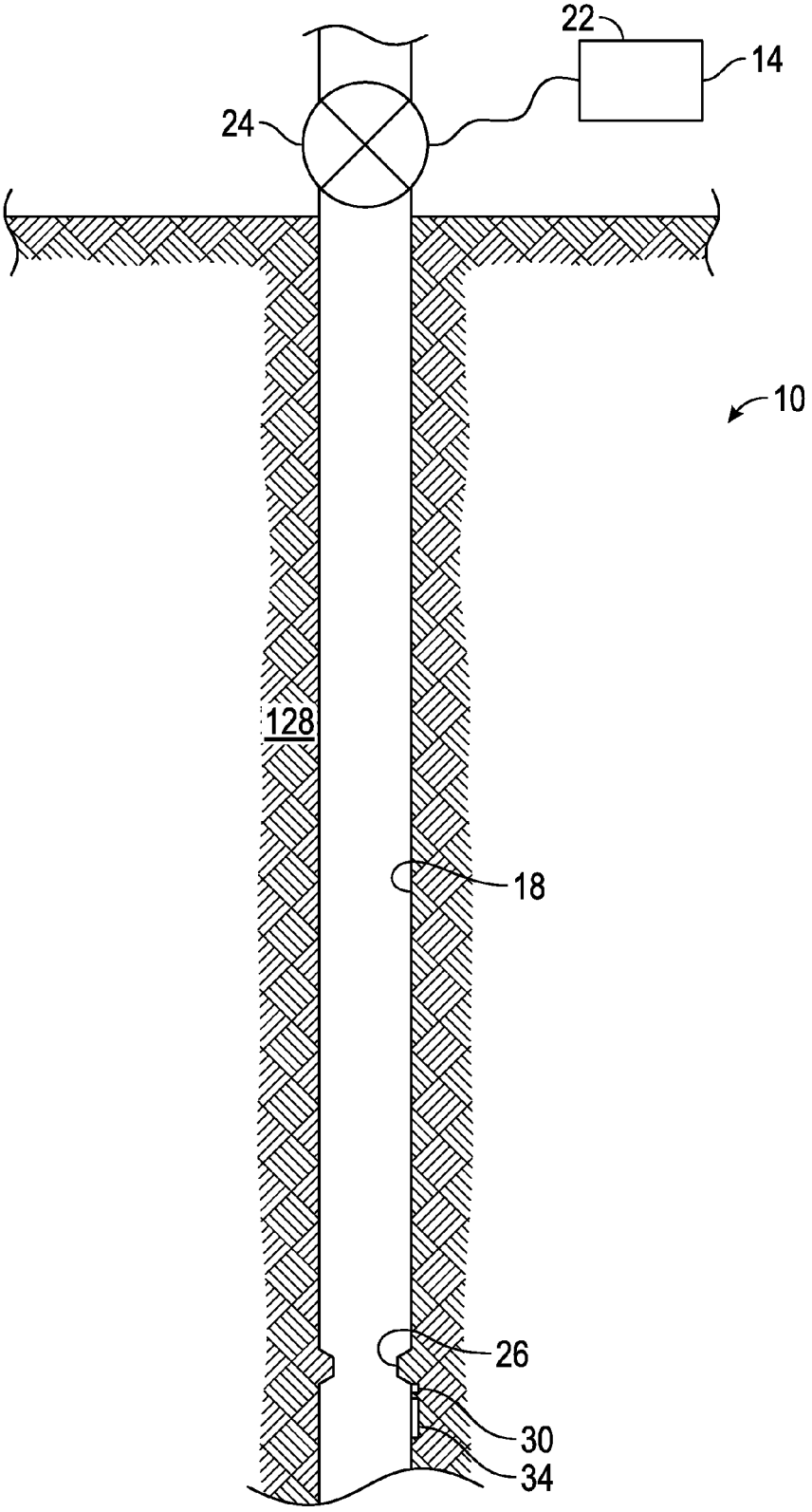
FIG. 1 depicts a schematic of a telemetry system disclosed herein.

Referring to FIG. 1, an embodiment of a telemetry system disclosed herein is illustrated at 10. The telemetry system 10 includes a pump 14 in fluidic communication with a tubular 18 such that the pump 14 pumps fluid through the tubular 18, and a flow altering arrangement 22 in operable communication with the pump 14 or the tubular 18 configured to alter flow of fluid through the tubular 18. Although the flow altering arrangement 22 in this embodiment is illustrated as being the pump 14, in other embodiments the flow altering arrangement 22 can be a variably restrictive opening valve 24, or a dumping valve, for example. The system further includes a flow interacting detail 26 disposed in the tubular 18 with a load sensor 30 in operable communication with the flow interacting detail 26 and the tubular 18 configured to detect forces imposed on the flow interacting detail 26 due to fluid flow through the flow interacting detail 26. A processor 34 can monitor and/or record output signals from the load sensor 30 for perform analysis to determine what is being communicated via the telemetry system 10.

The foregoing system 10 allows an operator to communicate over a distance through the tubular 18 between the flow altering arrangement 22 and the load sensor 30. Doing so includes altering flow rates of fluid pumping through the tubular 18 and through the flow interacting detail 26 sensing force exhibited on the flow interacting detail 26 related to the fluid flow rate therethrough and tracking the sensed force over a period of time. This relationship may be a proportional relationship wherein the force measured on the flow interacting detail 26 is proportional to the rate of fluid flow through the flow interacting detail 26. The system 10 allows data to be transmitted from the flow altering arrangement 22 to the load sensor 30. This data can be carried via a digital modulation scheme with a continuous phase to impose the information on a carrier signal, such as continuous phase modulation, for example.

Figure 2:
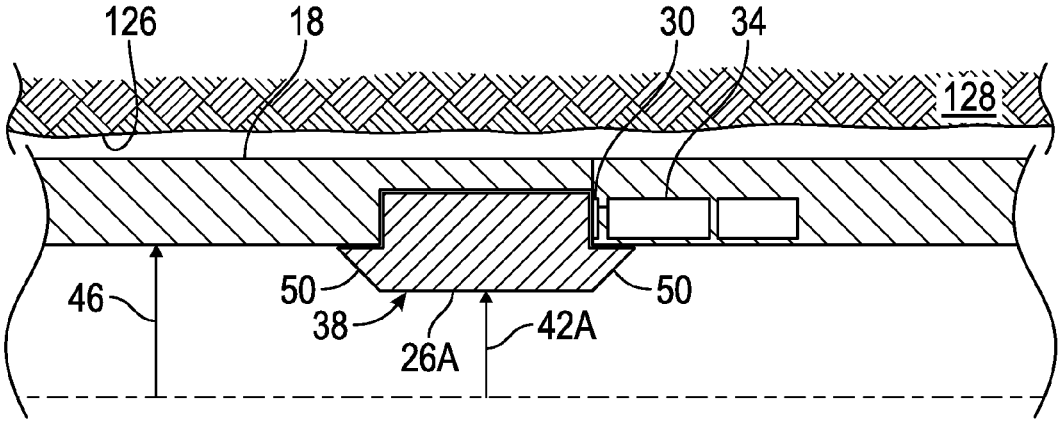
FIG. 2 depicts a partial cross sectional view of a portion of the telemetry system of FIG. 1.

Referring to FIG. 2, a portion of the telemetry system 10 is illustrated in cross section. In this embodiment the load sensor 30 is positioned between the flow interacting detail 26A and the tubular 18 on a downhole side (rightward in the Figure). In alternate embodiments the load sensor 30 could be positioned on an uphole side (leftward in the Figure) of the flow interacting detail 26A, or two of the load sensors 30 could be employed with one located at either side of the flow interacting detail 26A. Regardless of its relative position to the flow interacting detail 26A the load sensor 30, also often referred to as a load cell, can be in the form of a strain gauge, a piezoelectric sensor, a capacitive sensor, or other type of load cell, or combinations of one or more of the foregoing, for example. The load sensor 26A is configured to measure the force on the flow interacting detail 26A in relation to the tubular 18. The load sensor 26A is configured to measure the force between the flow interacting detail 26A and the tubular 18 while requiring substantially no movement between the flow interacting detail 26A and the tubular 18.

The flow interacting detail 26A defines an orifice 38 through which the fluid flows while interacting therewith. The orifice 38 defines a minimum radial dimension 42A of the flow interacting detail 26A. In this embodiment the minimum radial dimension 42A is smaller than a minimum radial dimension 46 of the tubular 18. Since the flow interacting detail 26A has the single orifice 38, as opposed to a tortuous path, for example, tools can be run therethrough while leaving the telemetry system 10 in place and functionally undisturbed. Angled surfaces 50 on both longitudinal ends of the flow interacting detail 26A allow tools run therethrough to be directed through the orifice 38 to avoid hanging up on the flow interacting detail 26A.

Figure 3:
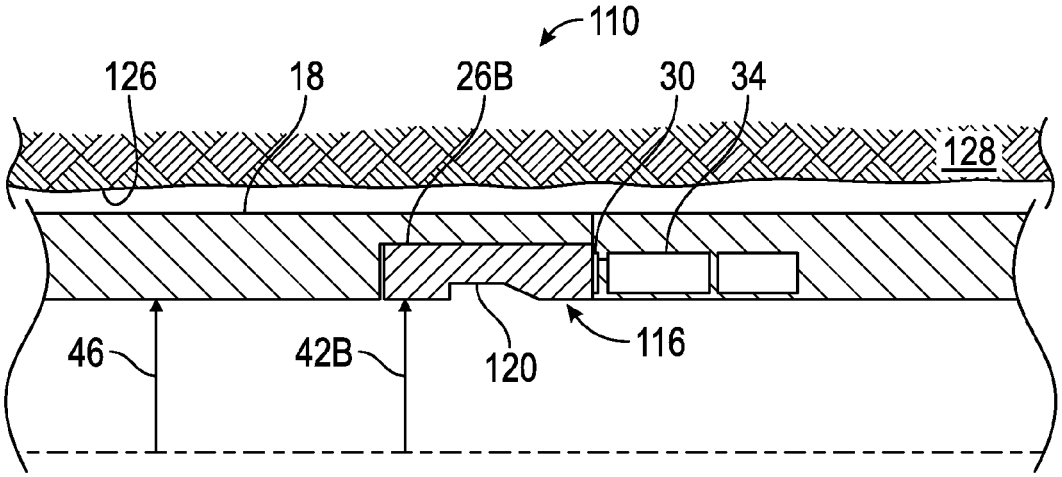
FIG. 3 depicts a partial cross sectional view of a portion of an alternate telemetry system disclosed herein.

Referring to FIG. 3, an alternate embodiment of a portion of a telemetry system disclosed herein is illustrated at 110. Similar items to those of telemetry system 10 are numbered alike. The system 110 differs from the system 10 primarily in the configuration of the flow interacting detail 26B. The flow interacting detail 26B has an inner radial surface 116 that defines a minimum radial dimension 42B of the flow interacting device 26B. It is important to note that the minimum radial dimension 42B is no smaller than a minimum radial dimension 46 of the tubular 18. As such, the flow interacting detail 26B provides substantial no impediment to the running of a tool therethrough over running it through the tubular 18 alone. The flow interacting detail 26B includes a recess 120 in an inner radial surface 116 that interacts with flow through the flow interacting detail 26B to generate forces thereon that are detectable by the load sensor 30.

The telemetry systems 10, 110 disclosed herein can continue to be used after, and indeed, even while a tool, such as a wireline tool, a coiled tubing tool or a tubing encapsulated conductor tool, for example, is positioned within the tubular 18 and positioned through the flow interacting details 26A, 26B. allowing tools to be run therethrough without disruption to function of the telemetry systems 10, 110 allows them to be used in applications where conventional telemetry systems are typically not employed. Such applications include in downhole completions systems in the hydrocarbon recovery and carbon dioxide sequestration industries. As such, in addition to being employable in a drill string the systems 10, 110 can be employed in a casing 124 or liner that is configured to stay within a wellbore 126 in an earth formation 128 permanently.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A telemetry system comprising:

a tubular having a wall defining an inner annular surface;

a pump in operable communication with the tubular configured to pump a fluid through the tubular;

a flow altering arrangement in operable communication with at least one of the pump and the tubular;

a flow interacting detail mounted to the wall extending about the inner annular surface of the tubular; and a load sensor configured to measure forces imposed on the flow interacting detail due to flow through the flow interacting detail and output signals related to the forces measured.

2. The telemetry system of claim 1, wherein the output signals are proportional to the forces measured.

3. The telemetry system of claim 1, further comprising a processor in operable communication with the load sensor configured to track the output signals over time.

4. The telemetry system of claim 3, wherein the telemetry system is configured to transmit data at least from the pump to the processor through changes in flow.

5. The telemetry system of claim 1, wherein the smallest radial dimensions of the flow interacting detail are no smaller than the smallest radial dimensions of the tubular.

6. The telemetry system of claim 1, wherein the flow interacting detail includes at least one recess on an inner radial surface thereof.

7. The telemetry system of claim 1, wherein the flow interacting detail allows passage of tools therethrough.

8. The telemetry system of claim 1, wherein the flow interacting detail includes an orifice.

9. The telemetry system of claim 1, wherein the tubular is one of a liner, a casing, and a drill string disposed in an earth formation borehole.

10. The telemetry system of claim 1, wherein the flow interacting detail and the load sensor remain downhole as part of a completion.

11. The telemetry system of claim 1, wherein the load sensor includes one or more of a strain gauge, a piezoelectric sensor, a capacitive sensor, or combinations of one or more of the foregoing.

12. The telemetry system of claim 1, wherein the flow interacting detail is substantially immovable in relation to the tubular.

13. The telemetry system of claim 1, wherein the flow altering arrangement is the pump.

14. The telemetry system of claim 1, wherein the flow altering includes altering rates of flow.

15. The telemetry system of claim 1, wherein the flow interacting detail extends entirely about the inner annular surface.

16. A method of communicating through a tubular, comprising:

flowing fluid through a tubular including a wall defining an inner annular surface and having a flow interacting detail mounted to the wall extending about the inner annular surface;

altering flow of the fluid through the flow interacting detail;

measuring force on the flow interacting detail related to the flow of the fluid; and tracking the measured force over time.

17. The method of communicating through a tubular of claim 16, further comprising transmitting data from an arrangement altering the flow to a sensor measuring the force.

18. The method of communicating through a tubular of claim 17, wherein the transmitting data is through continuous phase modulation.

19. The method of communicating through a tubular of claim 16, further comprising avoiding restricting intervention through the tubular and the flow interacting detail by not reducing inner radial dimensions of the flow interacting detail to dimensions smaller than minimum radial dimensions of the tubular.

20. The method of communicating through a tubular of claim 16, further comprising maintaining the relative position between the flow interacting detail and the tubular.

21. The method of communicating through a tubular of claim 16, wherein altering flow includes altering rates of flow.

* * * * *